United States Patent [19]

Takahashi et al.

[11] 4,355,459

[45] Oct. 26, 1982

[54] METHOD OF COILING A WIRE IN A TUBE

[76] Inventors: Teruo Takahashi, 7-42, 1-chome, Shimoizumi-cho, Niihama-shi, Ehime-ken; Rintaro Ito, 8-11, 2-chome, Nakamura, Niihama-shi, Ehime-ken, both of Japan

[21] Appl. No.: 128,651

[22] Filed: Mar. 10, 1980

[30] Foreign Application Priority Data

Mar. 10, 1979 [JP] Japan ..... 54/028047

[51] Int. Cl.[3] ..... H01F 41/06

[52] U.S. Cl. ..... 29/605; 29/433; 242/4 B; 242/7.03; 242/7.07

[58] Field of Search ..... 29/605, 606, 433; 140/92.1; 242/7.03, 7.07, 4 R, 4 A, 4 B

[56] References Cited

U.S. PATENT DOCUMENTS

| | | | |
|---|---|---|---|
| 3,066,388 | 12/1962 | Cooper | 242/7.07 X |
| 3,331,126 | 7/1967 | Fielder et al. | 29/433 X |
| 3,559,899 | 2/1971 | Fahrbach | 242/4 B |
| 3,702,499 | 11/1972 | Virsberg | 29/605 |
| 3,858,312 | 1/1975 | Gharaibeh | 29/605 |

FOREIGN PATENT DOCUMENTS 1389064 4/1975 United Kingdom .

*Primary Examiner*—Carl E. Hall

*Attorney, Agent, or Firm*—Fleit & Jacobson

[57] ABSTRACT

This invention provides an improvement of an apparatus and method of coiling an insulating electric wire in an insulating tube which is supported within a U shaped groove of a supporting frame provided on a stand. The wire is fed into the tube from a wire supporting roll by a wire lead mechanism having a driving friction roll and a vibratory friction roll controlled by a spring.

7 Claims, 5 Drawing Figures

METHOD OF COILING A WIRE IN A TUBE

BACKGROUND OF THE INVENTION

This invention relates to an improvement of an apparatus and method for making an electric coil winding which winds a wire a required number of times in a tube having appropriate openings and length.

Conventionally, an electric coil has a synthetic resin layer for insulation. It is well known that such electric coil is formed by steps of setting the wound coil in a die set, injecting synthetic resin in the die, immersing and molding the coil by the synthetic resin and removing the molded coil after hardening thereof. However, the conventional method uses a high price die and lacks productivity because of the need to make the die and process the coil.

Contrary, in case where such die is not used, an insulator which was infiltrated with synthetic resin prior to winding a wire, is used during semi-hardening thereof. After winding the wire and hardening of the insulator, the wound coil is obtained. But, when the infiltrated synthetic resin in the insulator is lacking, the capacity of the insulator is not sufficient because of inferior binding between the insulator. Therefore, it will bring adverse influence on the capacity of the electric coil which is highly hygroscopic.

As other propositions, there are methods of enclosure of the coil in which a wound wire is lapped in a vinyl tape, or the wound wire is inserted in a longitudinally opened vinyl tube, and the opening is closed by an adhesive or by a desposition. However, with regard to these methods, an equivalence of the insulator thickness is lacking, and in addition, uneconomical faults in these methods are unavoidable, since productivity is inferior and the required devices for tape or tube which are used in the coil winding machine are diverse.

SUMMARY OF THE INVENTION

The apparatus for the present invention comprises substantially a frame having at least one cutout portion and supporting an insulating tube, a wire lead means provided in the cut out portion of the frame comprising a driving friction roll and a vibratory friction roll which is controlled by spring means, and a removable tube which is supported in a groove of the frame. The method of the present invention comprises substantially the following steps; leading a wire into the tube through the wire leading means, rotating the wire in the tube by the wire leading means, and insulating an exposed portion of the wound wire between the both openings of the tube.

The inventors of the present invention completed this invention after studying the above stated conventional apparatus and method.

Accordingly, an object of the present invention is to provide an apparatus and method of coiling a wire in an insulating tube and making insulation treatment therein, without prior winding of the wire of coil material as a coil.

Another object of the present invention is to provide an apparatus and method of coiling a wire that provides elimination or reduction of labor for manufacturing of the insulated coil.

A further object of the present invention is to provide an apparatus and method of coiling a wire to economically obtain an electric coil in which the wrapped up insulator layer becomes equivalent and has the excellent capacity of insulation.

A still further object of the present invention and many of the attendant advantages thereof will be readilly appreciated as the same becomes better understood by reference to the following description.

BRIEF DESCRIPTION OF THE DRAWINGS

The accompanying drawings illustrate the preferred embodiments of the present invention. In the drawings, the same reference numerals illustrate the same parts of the invention, in which.

THE DETAILED DESCRIPTION OF THE INVENTION

Figure 1:
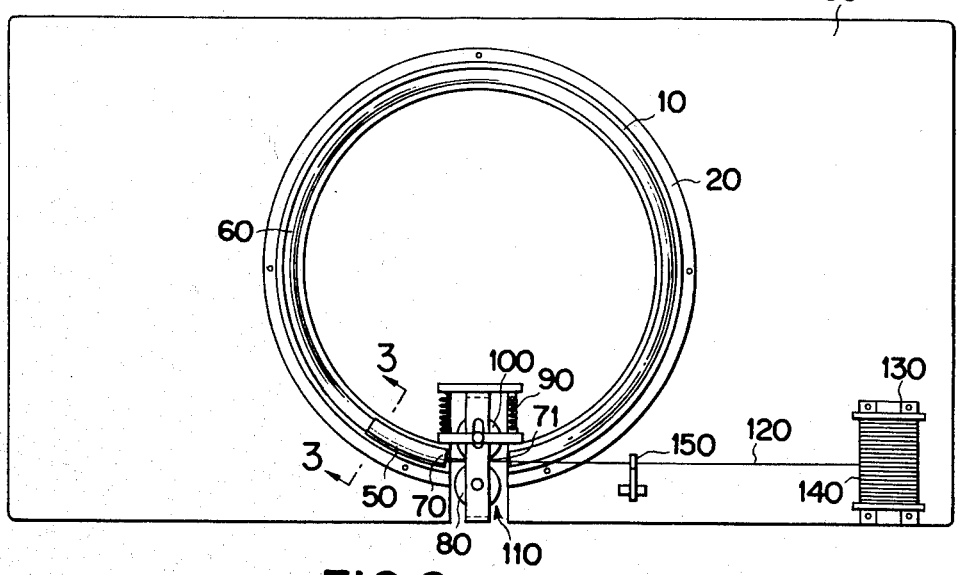
FIG. 1 is a top plan view of an apparatus for winding a wire according to one embodiment of the present invention.

Referring to the drawings, there is shown according to one preferred embodiment of the invention, as shown in FIG. 1, a supporting frame 20 which has a U shaped annular groove 10 and is removably set on an approximately high stand 30. An insulating tube 60 which has a desired diameter and is made from a synthetic resin of vinyl chloride or polypropylene, etc., is annularly set in and along the groove 10. End openings 70, 71 of the tube 60 face and are separated from each other. The tube 60 is supported so as not to move axially in the groove 10 a sleeve 50 is slidably nested around the body of the tube 60 in advance. The sleeve 50 is made from thermoplastic synthetic resin of polyethylene or silicone resins in order to cover the exposed part of the coil after winding.

A wire lead means 110 is provided between both open ends of the insulating tube 60. The wire lead means comprises a friction driving roll 80 which has rubber surface and is rotated in connection with a driving means which is not shown in the drawings, and a vibratory friction roll 100 controlled by pressed springs 90.

A wire supply roll 40 on which the wire 120 was wound, is rotatably provided on the desired high stand 30 at location 130, or is supported at an appropriate portion by any other means. In accordance with rotation and friction of said both rolls 80, 100, the insulated wire 120 is drawn out from the wire supply roll 140 and is fed into one opening 70 of the insulated tube 60 through a guide link 150 and between the driving friction roll 80 and another vibratory friction roll 100, that is, the wire 120 which is drawn out from the wire supply roll 140 is correctly and tangentially faced and led to the opening 70 so the wire is fed into the insulating tube 60. An tip of the wire 120 which comes out of another opening 71 of the tube 60 is again led and fed through the both friction rolls 80 and 100 into the opening 70 in which the tip of the wire is first fed.

By rotation of the driving friction roll 80 cooperating with the vibratory friction roll 140, the coil being formed is accordingly rotated and the wire is wound a desired number of times to obtain a coil 40. When the wire 120 is wound desired times, the wire from the wire supply roll 140 is cut at a location spaced from the opening, and the both tips of the wire are kept out and reserved as end terminals 160 and 161.

The insulating tube 60 in which the coil 40 is filled up is removed from the U shaped annular groove 10, and the coil exposed portion between the both openings 70 and 71 is insulated by winding an insulated adhesive tape thereon or by sliding the thermoplastic synthetic resin sleeve 50 thereto, which thermoplastic synthetic resin sleeve was nested around the body of the tube 60 in advance.

After covering the both openings 70 and 71 of the insulating tube 60 and the exposed portion of the coil 40 from the tube 60, the sleeve 50 nested between the both openings of the tube 60 is fused with heat of an appropriate heater, and then the hermetically sealed up and insulated coil 40 is obtained.

Measurement of the number of times of winding the wire of the coil 40 in the above disclosed construction is performed by a conventional counter apparatus (not shown in the drawings) which is provided in contact with the driving friction roll 80 in proportion to the relation between the radius and number of rotations of the driving friction roll 80, and the length of the wire 120 fed into the tube 60 for a given period of time.

The coil 40 formed by winding the wire for a desired number of times is obtained by automatically controlling and stopping rotary movement of the driving friction roll 80 after the coil 40 in the insulating tube 60 is wound for the desired times, according to the predetermined number of times of rotation of the roll 80 corresponding to the desired number of windings of the coil 40.

Figure 2:
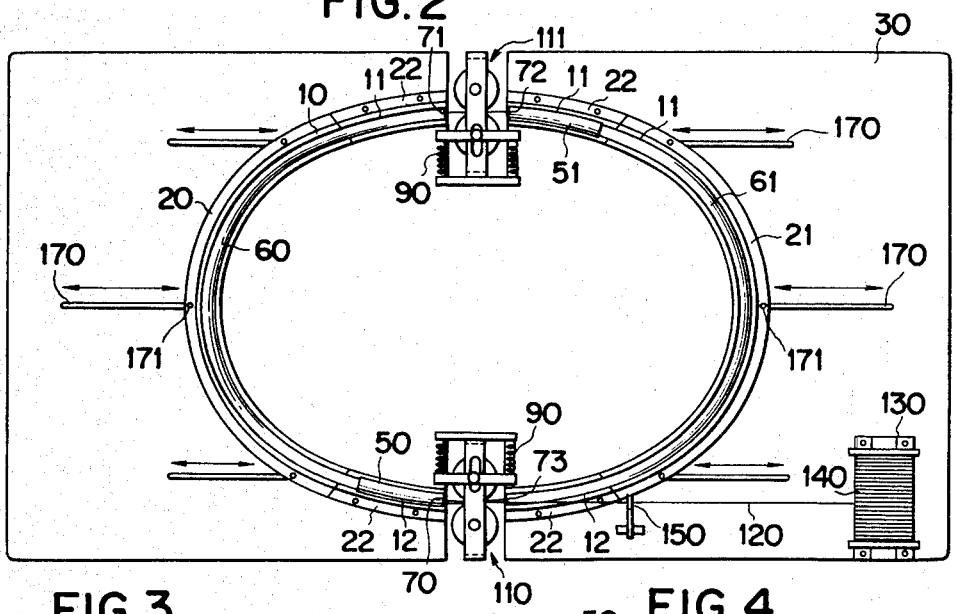
FIG. 2 is a top plane view of another embodiment for winding of a wire according to the present invention.
Figure 3:
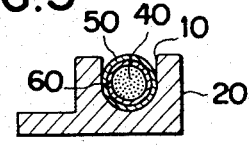
FIG. 3 is an enlarged cross sectional view along line 3—3 in FIG. 1.
Figure 4:
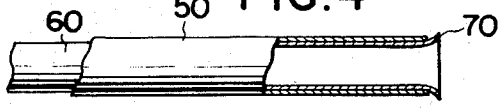
FIG. 4 is an enlarged partially cross sectional view of an opening end of an insulating tube.
Figure 5:
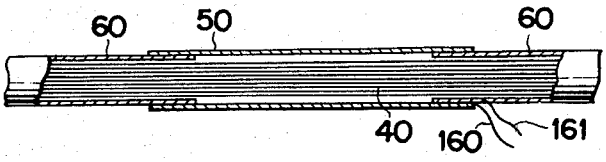
FIG. 5 is an enlarged partially cross sectional view showing a manner of covering of a sleeve set between both end openings of the insulating tube.

With regard to another embodiment of the present invention shown in FIG. 2, the supporting frame is divided at the center portion thereof, and the right and left supporting frames 20 and 21 having the corresponding U shaped annular grooves 10 and 11 are provided instead of one supporting frame 30 formed with U shaped annular groove 10 in the construction of the supporting frame 30 for the above stated insulating tube.

The right and left supporting frames 20 and 21 are positioned for appropriate sliding and removing thereof in accordance with the radius of the coil 40, and the supporting frame 20 and 21 providing the desired semicircular form is set, then the coil 40 having the desired radius and form is obtained by the apparatus of this embodiment of the present invention.

In case where it is desired to obtain the coil having the specially large radius, it is provided between the both supporting frames 20 and 21, at least one pair of a partial and supplementary supporting frames 22 having U shaped groove 12 respectively corresponding to the U shaped groove 10 and 11 for supporting the insulating tube 60 in order to form a serially annular U shaped groove by the grooves 10, 11 and 12.

Further, in case where the radius of the coil 40 is especially large, instead of winding the wire by one wire lead means 110 provided between the both openings of the insulating tube 60, the tube is divided to two or more partial tubes 61, and 60 which are supported in the U shaped groove 10, 11 and 12 of the supporting frames 20 and 21. These are serially set along the U shaped grooves 10, 11 and 12 and desired spaces are provided between the faced openings 70 and 73 and other faced opening 71 and 72 respectively of the insulating tubes 60 and 61, then, in the spaces wire lead means 110 and 111 are set respectively in order to easily lead and feed the wire 120 resisting the frictional resistance when the coil in the tube 60, and 61 is rotated.

Accordingly, it can be adapted the construction by which winding is easily operated by smooth rotation of the coil in the insulating tubes 60 and 61.

Still further, in case of modification of constructions where the openings 70, 71, 72 and 73 of the insulating tubes 60 and 61 are formed with trumpet shaped or funnel shaped ends, it can easily lead the wire 120 into the insulating tubes and it can prevent the sleeves 50 and 51 which were nested around the insulating tubes and are slided to and covered on the exposed coil 40 after coiling from slippage of the sleeves 50 and 51 of overlapped portions with the ends of the tubes 60 and 61 also it can favorably and hermetically fuse the overlapped portions and can increase the insulating and sealing effects thereof.

When using a plurality of the separated supporting frames, the frames are able to slide along the slots as shown by arrows in FIG. 2, which are provided on the stand 30, and the supporting frame or frames are fixed by a fixing means 171 such as bolt means.

As one example of the present invention, an experienced effect is stated as follows. It takes one minute for the time occupied on winding the wire 66 times using the apparatus which is provided only one wire lead means, including the time occupied on drawing the wire into the insulating tube for making the wire to wound condition through the wire lead means. In the example, the used insulating tube is 4 millimeters in diameter and is 1 meter in length, the both end openings of the insulating tube are faced towards each another so as to keep distance of 40 millimeters, and the annular tube is set in the U shaped groove of the supporting frame. Also, the wire is 0.29 millimeter in diameter.

In accordance with the present invention having the above stated construction, it is very easy to make insulating treatment of the coil wound in the insulating tube, also it can provide the product at low cost, since it can be expected elimination or reduction of labor can be expected in working of winding, insulating and sealing of the coil.

Further, it can obtain the high quality coil being excellent in insulating and sealing treatment.

Still further, it is expected to curtail expenses of the cost of equipment, as the construction of the apparatus is exceedingly simple.

The invention may be embodied on other specific forms without departing from its spirit or essential characteristics. The described embodiment is to be considered in all respect only as illustrated and not restrictive and the scope of the invention is, therefore, indicated by the appendant claims rather than by the foregoing description. All changes which come within the meaning and range of equivalency of the claims are to be amended within their scope. Consequently, it is recognized that many variations may be made without departing from the scope or spirit of the present invention.

What is claimed is:

1. Method of coiling a wire comprising:

positioning a hollow tubular member in a frame in such manner that the tubular member is held in a fixed position and a first gap is formed between first and second ends of the tubular member;

inserting a leading end of wire into the tubular member through the first end;

continuously feeding the wire into the tubular member by wire feeding means having a friction driving roll cooperating with a vibratory friction roll so that the leading end of the wire advances through the tubular member and wire enters the tubular member through the first gap, the leading end of the wire exiting from the second end of the tubular member and entering again the first end whereby continuous feeding of the wire forms a coil within the tubular member;

removing the tubular member and coil from the frame;

sliding a sleeve over an end of the tubular member prior to positioning the tubular member in the frame; and sliding the sleeve with respect to the tubular member after formation of the coil so that the sleeve is moved into a covering position covering a portion of the coil located in the first gap.

2. A method according to claim 1, wherein said tubular member comprises two tubes, the tubes having confronting ends spaced from each other to define the first gap and to define a second gap, said method further comprising contacting the wire during its passage through the second gap to assist feeding of the wire to form the coil.

3. A method according to claim 1 or 2, wherein said first end of the tubular member is trumpet spaced to facilitate feeding of wire into the first end.

4. A method according to claim 1, wherein said sleeve in the covering position has end portions covering the first and the second ends of the tubular member and wherein said sleeve is formed from a heat shrinkable material, said method further comprising heating the sleeve to thereby shrink the sleeve and seal the first gap.

5. A method according to claim 2, further comprising:

sliding a first and a second sleeve over portions of said tubes forming the tubular member prior to positioning the tubes in the frame; and sliding the first and the second sleeves into covering positions covering portions of the coil located in the first and the second gaps.

6. A method according to claim 5, wherein the lengths of said sleeves are at least equal to the lengths of said gaps and wherein said sleeves are formed of heat shrinkable material, said method further comprising heating said sleeves to thereby shrink said sleeves and seal said gaps.

7. A method of coiling a wire using an apparatus having a frame for holding a tubular member in a fixed position and wire feeding means having a friction driving roll for advancing wire, said method comprising:

positioning a hollow tubular member in a fixed position in the frame, the tubular member having first and second ends spaced from each other to define a gap adjacent the wire feeding means;

actuating the wire feeding means to feed a leading end of wire into the first end of the tubular member whereby continued feeding of wire into the tubular member through the first gap advances the leading end of wire through the tubular member, out of the second end, and back into the first end to thereby form a coil within the tubular member;

removing the tubular member and coil of wire from the frame;

sliding a sleeve over an end of the tubular member prior to positioning the tubular member in the frame; and sliding the sleeve with respect to the tubular member after formation of the coil so that the sleeve is moved into a covering position covering a portion of the coil located in the first gap.

* * * * *